US005209163A

United States Patent [19]

Banike

[11] Patent Number: 5,209,163

[45] Date of Patent: May 11, 1993

[54] PRINTING CYLINDER WITH RETRACTABLE PLATE REGISTER PIN AND METHOD OF ASSEMBLY

[75] Inventor: Ronald Banike, Orland Park, Ill.

[73] Assignee: R. R. Donnelley & Sons Company, Lisle, Ill.

[21] Appl. No.: 426,510

[22] Filed: Oct. 23, 1989

Related U.S. Application Data

[63] Continuation of Ser. No. 826,978, Feb. 7, 1986, abandoned.

[51] Int. Cl.[5] ..... B41F 27/00

[52] U.S. Cl. ..... 101/483; 101/378; 101/389.1; 101/415.1

[58] Field of Search ..... 101/389.1, 415.1, 383, 101/DIG. 12, 483, 485, 486, 378; 400/616, 616.1; 226/81; 271/82, 232, 245; 411/451, 455; 173/71, 73; 408/56; 33/618, 619, 621, 614; 355/86, 95

[56] References Cited

U.S. PATENT DOCUMENTS

| | | | |
|---|---|---|---|
| 560,186 | 5/1896 | Beidelman | 411/451 |
| 1,791,761 | 2/1931 | Larrabee | 101/415.1 X |
| 2,432,967 | 12/1947 | Johnson | 226/81 X |
| 2,621,592 | 12/1952 | Faeber | 101/415.1 |
| 2,629,324 | 2/1953 | Smith | 101/415.1 |
| 2,631,349 | 3/1953 | Houston | 101/415.1 X |
| 2,913,093 | 11/1959 | Bevan | 226/81 X |
| 3,198,084 | 6/1965 | Raybuck | 271/82 |
| 3,410,469 | 11/1968 | Deeg | 226/81 |
| 3,456,587 | 7/1969 | Halen | 101/415.1 |
| 3,496,866 | 2/1970 | Nystrand | 101/378 |
| 3,509,819 | 5/1970 | Conole | 101/378 |
| 3,630,253 | 12/1971 | Sherman | 411/455 X |
| 3,696,744 | 10/1972 | Etchell | 101/415.1 |
| 3,745,626 | 7/1973 | Bray | 101/382 MV X |
| 3,882,775 | 5/1975 | Lytle et al. | 101/415.1 |
| 3,919,937 | 11/1975 | Kostal | 101/378 |
| 3,943,852 | 3/1976 | Czinger | 101/415.1 |
| 4,313,378 | 2/1982 | Etchell et al. | 101/415.1 |
| 4,334,674 | 6/1982 | Ishii | 271/245 |
| 4,351,610 | 9/1982 | Skrypek et al. | 355/95 X |
| 4,467,722 | 8/1984 | Klingelhoefer et al. | 101/415.1 X |
| 4,557,196 | 12/1985 | Kobler | 101/415.1 |
| 4,589,338 | 5/1986 | Collins et al. | 101/415.1 X |
| 4,628,815 | 12/1986 | Von Kanegan | 101/382 MV X |
| 4,679,502 | 7/1987 | Jeschke | 101/415.1 |
| 4,727,806 | 3/1988 | Green, Sr. | 101/415.1 |

FOREIGN PATENT DOCUMENTS

| | | | |
|---|---|---|---|
| 1611383 | 12/1970 | Fed. Rep. of Germany . | |
| 2340980 | 4/1973 | Fed. Rep. of Germany . | |
| 566981 | 7/1977 | U.S.S.R. | 411/451 |
| 2049859 | 12/1980 | United Kingdom | 411/455 |

*Primary Examiner*—Edgar S. Burr
*Assistant Examiner*—Christopher A. Bennett
*Attorney, Agent, or Firm*—Wood, Phillips, VanSanten, Hoffman & Ertel

[57] ABSTRACT

A magnetic printing cylinder has retractable plate register pins. The printing plate is positioned on the cylinder by engagement of an edge of the plate with the pins in extended position. The pins are moved to retracted position and the plate wrapped around the cylinder. The pin moves radially of the cylinder in a bushing. O-rings on the pin limit outward movement of the pin and resist pin rotation. In assembly of the cylinder, the pin and bushing extend above the cylinder surface and are ground to the final cylinder dimension.

16 Claims, 1 Drawing Sheet

FIG. 1
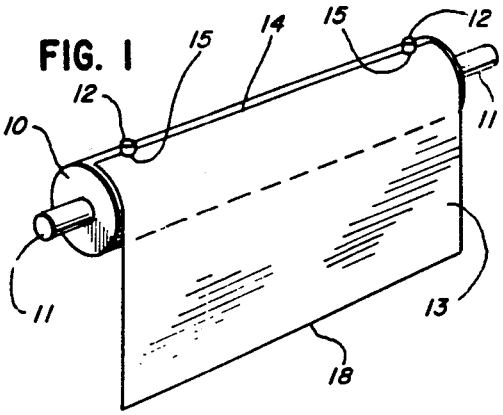
FIG. 2
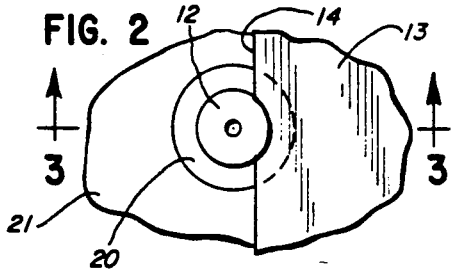
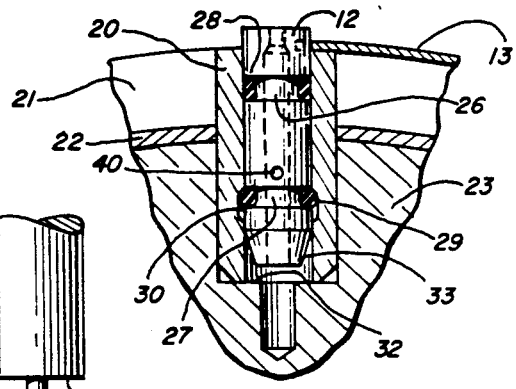
FIG. 3
FIG. 4
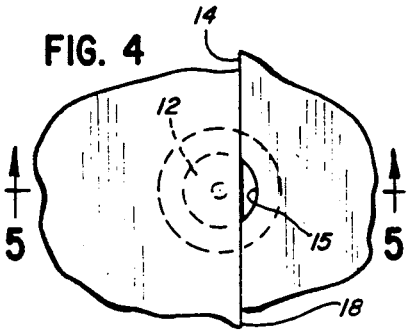
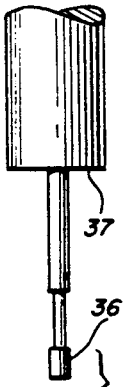
FIG. 5
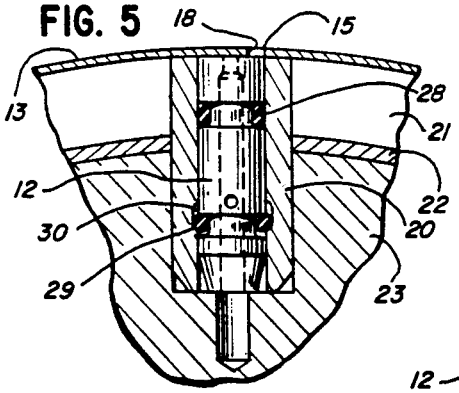
FIG. 6
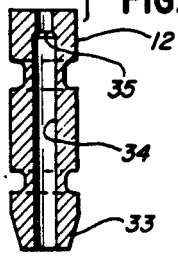
FIG. 7
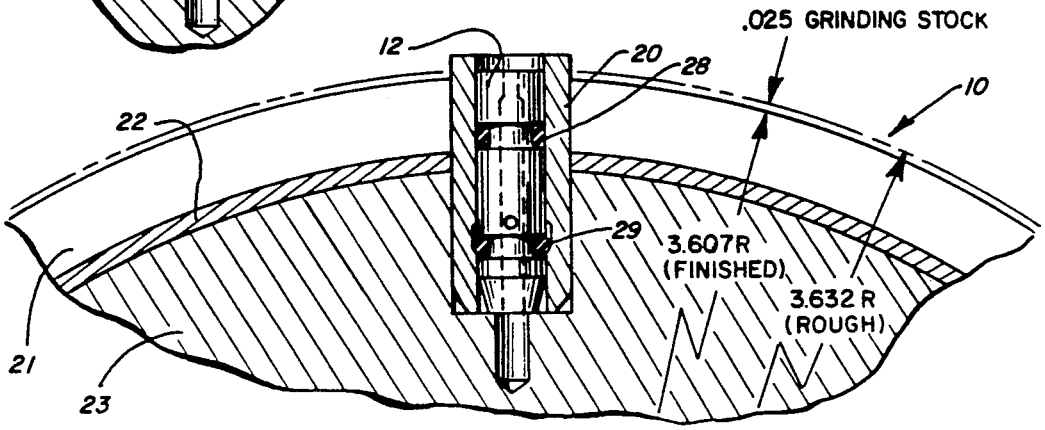

PRINTING CYLINDER WITH RETRACTABLE PLATE REGISTER PIN AND METHOD OF ASSEMBLY

This application is a continuation of application Ser. No. 826,978, filed Feb. 7, 1986 now abandoned.

This application relates to a plate register pin for positioning a printing plate on a printing cylinder and more particularly to a registration pin which is movable between extended and retracted positions and to a method of cylinder assembly.

BACKGROUND OF THE INVENTION

In some printing applications the printing plate (or blanket) is mounted on a magnetic cylinder and is held on the surface of the cylinder by magnetic attraction. If precise positioning of the plate on the cylinder is important, the cylinder may have one or more register pins which locate the plate. One such construction is shown in Kostal 3,919,937.

Some printing plates are quite thin, for example, less than 0.020" in thickness. The register pin should not extend above the plate surface. With such a small pin height, engagement of the plate edge with the pin while manipulating the plate on the magnetic cylinder surface is difficult. Moreover, to avoid having a longitudinal gap between the plate edges, it is necessary that both edges be notched to fit the pin.

SUMMARY OF THE INVENTION

In accordance with the invention, the cylinder is provided with a retractable register pin.

More particularly, means defining a hole extend inward from the peripheral surface of the cylinder and the pin is slidable in the hole between an extended position with a portion of the pin above the cylinder surface for engagement with the printing plate and a retracted position in which the pin does not extend above the cylinder surface. In the extended position, the pin is preferably above the cylinder surface a distance greater than the plate thickness and in the retracted position the pin is flush with the cylinder surface.

Another feature of the invention is that the hole in the cylinder is defined by a bushing fitted in the cylinder, the register pin being movable radially of the cylinder in the bushing. An O-ring on the pin moves in a groove on the inner wall of the bushing, limiting the movement of the pin outwardly of the cylinder. A second O-ring on the pin grips the inner wall of the bushing, preventing rotation of the pin.

A further feature of the invention is the method of assembly of the retractable plate register pin with a printing cylinder comprising the steps of drilling a hole in the cylinder, inserting a bushing and pin in the hole with both the bushing and the pin extending beyond the finished surface dimension of the cylinder and cutting the bushing and pin to the finished surface dimension.

Further features and advantages of the invention will readily be apparent from the following specification and from the drawings, in which:

FIG. 1 is a diagrammatic perspective of a cylinder with register pins and a printing plate;

FIG. 2 is an enlarged fragmentary plan of the cylinder, register pin in extended position and one edge of a printing plate.

FIG. 3 is a section taken along line 3—3 of FIG. 2;

FIG. 4 is a view similar to FIG. 2 with the pin retracted and the plate wrapped around the cylinder;

FIG. 5 is a section taken along line 5—5 of FIG. 4;

FIG. 6 is a diagram of the pin and a pull tool used in removing the pin from the retracted to extended position; and FIG. 7 illustrates the manufacture of the cylinder and register pin.

A magnetic cylinder for a printing plate or for an offset blanket is shown in Peekna application Ser. No. 763,128 filed Aug. 6, 1985, now U.S. Pat. No. 4,676,161, and assigned to the assignee of this invention. The retractable register pin of this application is particularly suited for use in mounting a printing plate on the Peekna printing plate cylinder. The register pin may also be used in mounting the blanket and carrier plate on the blanket cylinder, as well as with plates or blankets on other magnetic cylinders.

In FIG. 1 a magnetic cylinder 10 has shafts 11 for mounting in a press. Register pins 12 extend radially outwardly from the cylinder surface. A printing plate 13 of ferromagnetic material has an edge 14 with notches 15 which engage the register pins 12 locating the plate circumferentially and longitudinally of the cylinder.

The register pin 12 is shown in extended position in FIGS. 2 and 3, and in retracted position in FIGS. 4 and 5. With the pin 12 extended, the edge 14 of plate 13 is positioned against the side of the pin. The plate is wrapped around the cylinder 10, the pin 12 retracted as seen in FIGS. 4 and 5 and the edge 18 of the plate lies adjacent notched edge 14.

With a pin diameter of the order of ¼ inch, the notch 15 may have a depth of the order of 1/32 inch. The small gap in the plate surface is negligible.

The pin 12 is cylindrical and is movable radially of the cylinder in a bushing 20 which extends into the cylinder through the magnetic structure 21, brass sleeve 22 and into the iron core 23 of the cylinder. There are two spaced apart grooves 26, 27 on the outer surface of pin 12 in which O-rings 28, 29, respectively, are received. O-ring 29 is seated in an elongated groove 30 in the inner wall of bushing 20. The upper surface of the O-ring 29 engages a complimentary upper surface of grooves 30 limiting the movement of pin 12 outwardly to its extended position, as seen in FIG. 3. For a plate thickness of 0.015 to 0.02 inch, the register pin in its extended position may be 0.05 inch above the cylinder surface. Inward movement of the register pin 12 is limited by engagement of the inner end of the pin with the inner surface 32 of the hole in cylinder core 23.

O-ring 28 is compressed against the inner wall of bushing 20 and prevents rotation of the register pin. The O-rings are preferably on the outer surface of the pin rather than on the inner surface of the bushing to facilitate mounting and replacement. The inner end of the pin is tapered at 33 to facilitate insertion of the pin into the O-rings.

Register pin 12 has a longitudinal bore 34 extending therethrough to relieve fluid pressure inside bushing 20. A shoulder 35 in the bore is engageable by the head 36 of a tool 37, FIG. 6, to pull the pin to its extended position. A hole 40 extends laterally through the wall of pin 12 to the longitudinal bore 34 at a point between the O-rings 28, 29. This hole relieves fluid trapped between the pin and the inner wall of bushing 20.

The cylinder is fabricated with the magnetic structure 21 oversize. The surface of the cylinder is then ground or otherwise cut to the desired dimension. The register pin 12 is assembled with the cylinder as a part of this operation. First, a hole is drilled in the cylinder to receive bushing 20. The bushing, which is longer than the desired finished dimension, is inserted in the hole with its lower end seated on the surface 32 at the base of the hole in the cylinder. Register pin 12 with the O-rings 28, 29 mounted thereon is then inserted into bushing 20 with its lower end seated on the surface 32. The length of pin 12 is such that its outer end is outside the finished surface of the cylinder. The cylinder, bushing 20 and pin 12 are then ground or otherwise cut to the desired finished dimension. The bore 34 through pin 12 is filled with a suitable material, as grease, during the cutting operation to keep metal particles out of the bore and bushing. The grease is removed after the cylinder has been cut. As indicated in FIG. 7, the rough radius of the cylinder is of the order of 3.632" while the finished radius is of the order of 3.607". The bushing 20 and pin 12 have initial lengths which may be such that they extend beyond the rough surface of the cylinder.

I claim:

1. In a printing cylinder having a peripheral surface and magnet structure for holding a thin elongate printing plate thereon, two retractable plate register pins comprising:

means defining a hole for each pin in each cylinder, said holes extending radially inwardly through said peripheral surface such that the register pins being spaced apart along a line parallel with the cylinder axis; and a pin slidably mounted in each hole for selective disposition in an extended position with an outer portion of the pin extending to above the cylinder surface a distance greater than the thickness of the printing plate for engagement with said printing plate for proper alignment of the printing plate and in a retracted position in which the pin outer portion does not extend above the cylinder surface a distance greater than the thickness of the printing plate, wherein the printing plate is positioned against the register pins for proper alignment while the magnetic structure of the cylinder simultaneously forces the plate down and around the cylinder surface.

2. The printing cylinder of claim 1 in which the pins, in the retracted position, are flush with said cylinder surface.

3. The printing cylinder and register pins of claim 1 in combination with a printing plate of ferromagnetic material having an edge surface and being registered on the cylinder by engagement of said edge surface of the plate with said pins in its extended position, the plate being wrapped around the cylinder and held thereon by magnetic attraction, the plate edge opposite said one plate edge lying closely adjacent said one plate edge with said pins in the retracted position.

4. The cylinder and printing plates of claim 3 in which said one plate edge has a notch therein which complements said register pins to position the plate peripherally and axially on the cylinder.

5. The cylinder and plate of claim 4 in which said pins are cylindrical and the notches in the plate edge have an angular extent less than 180°.

6. The retractable plate register pins of claim 1 in which the means defining a hole for each pin in the cylinder includes a bushing fitted in the cylinder with each register pin being movable radially of the cylinder in the bushing.

7. The retractable plate register pins of claim 6 including means providing complementary surfaces to limit movement of the pins outwardly of the cylinder.

8. The retractable plate register pin of claim 7 in which said last mentioned means comprises an O-ring on each pin which moves in an annular groove in the inner wall of the bushing.

9. The retractable plate register pins of claim 6 including an O-ring on each pin to grip the inner wall of said bushing, preventing rotation of the pins.

10. The retractable plate register pin of claim 6 including:

two spaced apart peripheral grooves on each pin;

an O-ring in each groove; and a groove in the inner wall of said bushing, receiving one of said O-rings to limit movement of the pins outwardly of the cylinder, the other O-ring engaging the inner wall of said bushing to prevent rotation of the pins.

11. The retractable plate register pins of claim 6 in which each pin has a bore extending axially thereof, the bore having a surface for engagement with a complementary surface on a tool to move the pins outwardly of the cylinder to its extended position.

12. The retractable plate register pins of claim 6 in which each pin has an axial bore therein with a relief hole extending laterally through the pin wall.

13. The method of assembly of a retractable plate register pin with a printing cylinder, comprising:

drilling a hole in an outer surface portion of the cylinder;

inserting a bushing and pin in said hole, with the pin retracted in the bushing, said bushing and pin extending to above said outer surface portion of the cylinder;

finishing the outer surface portion of the cylinder; and causing the bushing and pin to be flush with the finished surface of the cylinder.

14. The method of claim 13 in which said pin has an axial bore, the method including the step of filling said bore with a removable material before cutting the bushing and pin.

15. The method of claim 14 including the step of thereafter removing the material from the bore of the pin.

16. The method of claim 13 wherein said steps of finishing the outer surface portion and causing the bushing and pin to be flush with the finished outer surface portion are concurrently performed.

* * * * *